United States Patent [19]

Standley

[11] Patent Number: 4,525,394

[45] Date of Patent: Jun. 25, 1985

[54] ROSETTE BOW

[76] Inventor: Rosalie K. Standley, 9 Buckingham St., Sydenham, Victoria 3038, Australia

[21] Appl. No.: 572,844

[22] Filed: Jan. 23, 1984

[51] Int. Cl.[3] ..... A41G 1/00

[52] U.S. Cl. ..... 428/26; 156/61

[58] Field of Search ..... 428/24, 25, 26, 4; 156/61

[56] References Cited

U.S. PATENT DOCUMENTS 1,731,089 10/1929 Adams ..... 428/26 X 1,766,351 6/1930 Patterson ..... 428/26

*Primary Examiner*—Henry F. Epstein

*Attorney, Agent, or Firm*—Larson and Taylor

[57] ABSTRACT

A method of making artificial flowers and flowers made by the method which includes rolling one end of a strip of fabric about itself to form the center of the flower and then repetitively extending part of the free end outwardly and then folding it at an angle to its axis so that it lies adjacent the center to form a petal, the petals being spaced about the center and completing the flower by tying the free end of the strip and the lower ends of the petals about the center of the flower.

4 Claims, 7 Drawing Figures

ROSETTE BOW

This invention relates to a method of manufacturing artificial flowers.

There have been proposed a number of methods of manufacturing artificial flowers which have normally necessitated the formation of petals, either from a paper, fabric or plastics sheet material and assembling these on a stem, which may be so formed at one end to give the impression of the centre of a bloom.

It is the object of the invention to form an artificial flower from a single strip of material, which flower provides an accurate representation of a bud or newly opened bloom, which can be particularly useful for decorative purposes.

The invention includes a method of making artificial flowers comprising the steps of rolling one end of a strip of fabric about itself to form the centre of the flower, extending part of the free end of the strip outwardly therefrom, folding this at an angle to the axis of the strip and locating the "petal" so formed adjacent the central portion, repeating these steps to form the required number of petals and tying the free end of the strip and the lower ends of the petals so formed about the centre of the flower.

By the use of satinette ribbon, the method of the invention can provide a most lifelike rosebud and this can be completed by forming leaves of a different coloured, preferably green, material, which can be elongated and connected to each other with a central aperture through which the end of the rolled portion of the material can pass.

In order that the invention may be more readily understood, I shal describe the invention in relation to the accompanying drawings, in which:

FIGS. 1 to 4 relate to the formation of the actual bud;

To make a small rosebud as illustrated, I use a strip of ribbon 10 of material and, in one particular embodiment, I can use satinette ribbon which is 19 mm wide and 20 cm long.

Figure 1:
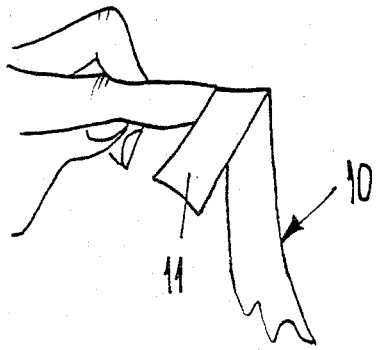
Figure 2:
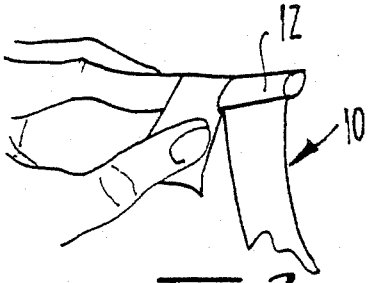
Figure 3:
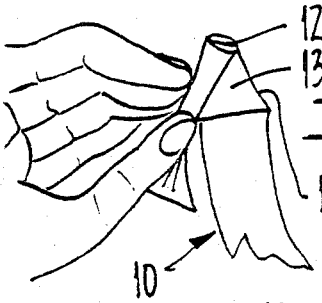

The free end 11 of the ribbon 10 is held in the position as illustrated in FIG. 1 and the ribbon 10 is rolled over to form the centre 12 of the bud and I prefer to use four rotations in this formation.

In order to form the petals, the portion 13 of the ribbon, which is the continuation from the centre 12, is extended outwardly and folded, as at 14, about itself and then moved upwardly so that it closely lies against the centre 12.

This step is repeated and, because of the relative positions of the outwardly extending portion, each petal 15 is located adjacent the preceding petal but displaced therefrom in a clockwise direction, if the bud is being made in the way illustrated.

Figure 4:
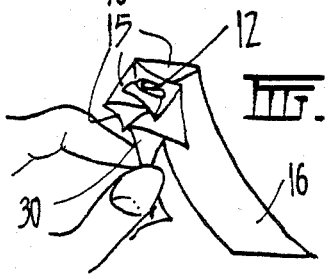
Figure 5:
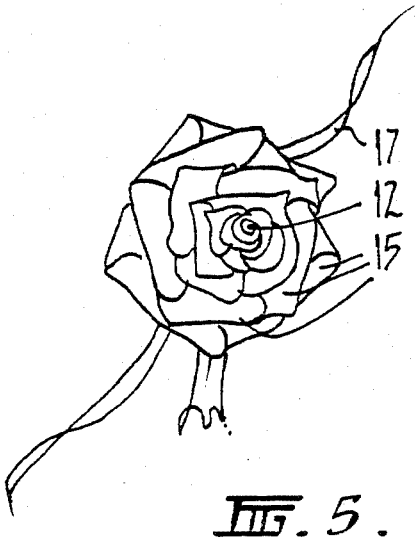
FIG. 5 shows the appearance of the bud after tying.

This procedure is continued and, as more petals are formed, they are forced to stand outwardly and , when some twenty petals have been formed, the bud looks basically as illustrated in FIG. 4.

The free end 16 of the ribbon is then brought inwardly beneath the bud and the petals are tied to the stem 30, which is formed by the lower ends thereof, by a strip of ribbon 17.

Figure 6:
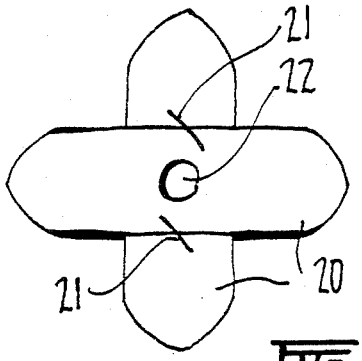
FIG. 6 shows the formation of the members which comprise the leaves.

I then form leaves for the rose from two lengths 20 of ribbon, which may be of the same width as the ribbon 10 or may be slightly wider, and these two lengths 20 are laid in a cruxiform, as illustrated in FIG. 6, and are held together as by staples 21 or, if required, by an adhesive. If the flower is to be realistic, I prefer to use green ribbon, but any other colour can be used if the flower is to be purely decorative.

A central hole 22 is made through these portions of ribbon.

After the ribbon 17 is tied, the free end of the stem of the bloom can be trimmed.

Figure 7:
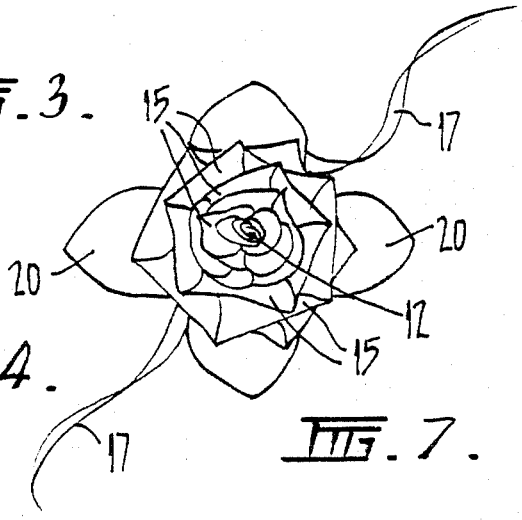
FIG. 7 is a view of a completed flower.

The free ends of the tying ribbon 17 are then passed through the central hole 22 of the leaves, as is the stem portion, and this causes the leaves to be pulled upwardly against the rear of the bud and the finished flower is as shown in FIG. 7.

The flower of the invention, as illustrated in FIG. 7, is particularly useful for use in decorative packaging, as for gift wrapping, but it could also be equally well be used as a display flower.

It must also be appreciated that, if required, several of these blooms could be connected together by a still further strip of ribbon or the like.

I claim:

1. A method of making artificial flowers comprising the steps of rolling one end of a strip of fabric about itself to form the centre of the flower, extending part of the free end of the strip outwardly therefrom, folding the free end in a line at an angle to the axis of the strip to form a petal and locating the petal so formed freely adjacent the central portion, repeating these steps to form the required number of petals and finally tying the free end of the strip and the lower ends of the petals so formed about the centre of the flower.

2. A method as claimed in claim 1 wherein leaves are formed from strips of fabric connected, one across the other, with their centrepoints in coincidence, forming a hole through the centrepoints and locating the lower end of the flower through this hole.

3. A method as claimed in claim 2 wherein the tie is also passed through the hole and acts to retain the leaves against the flower.

4. An artificial flower made by a method comprising the steps of rolling one end of a strip of fabric about itself to form the centre of the flower, extending part of the free end of the strip outwardly therefrom, folding the free end in a line at an angle to the axis of the strip to form a petal and locating the petal so formed freely adjacent the central portion, repeating these steps to form the required number of petals and finally tying the free end of the strip and the lower ends of the petals so formed about the centre of the flower.

* * * * *